United States Patent [19]

Spindt

[11] 4,141,405

[45] Feb. 27, 1979

[54] METHOD OF FABRICATING A FUNNEL-SHAPED MINIATURE ELECTRODE FOR USE AS A FIELD IONIZATION SOURCE

[75] Inventor: Charles A. Spindt, Menlo Park, Calif.

[73] Assignee: SRI International, Menlo Park, Calif.

[21] Appl. No.: 819,557

[22] Filed: Jul. 27, 1977

[51] Int. Cl.[2] ..... B22D 23/00

[52] U.S. Cl. ..... 164/46; 164/6

[58] Field of Search ..... 164/46, 19, 6, 72; 264/81, 309; 118/48, 49, 49.1, 49.5; 427/250, 251, 133, 135; 29/527.2, 423, 25.18

[56] References Cited

U.S. PATENT DOCUMENTS

| | | | |
|---|---|---|---|
| 3,244,852 | 4/1966 | Herterick et al. | 164/46 |
| 3,271,488 | 9/1966 | Dahlberg | 264/81 |
| 3,641,974 | 2/1972 | Yamada et al. | 118/48 |

*Primary Examiner*—Othell M. Simpson
*Assistant Examiner*—K. Y. Lin
*Attorney, Agent, or Firm*—Victor R. Beckman

[57] ABSTRACT

A method of fabricating a funnel-shaped miniature electrode with thin walls and very sharp edges for use in a field ionization source for ionizing components of a fluid sample is disclosed, which method includes the use of a female mold, or matrix, formed with a stepped, generally frustoconical-shaped aperture therethrough. The aperture wall includes a plurality of different diameter generally tapered wall sections of decreasing size in going along the aperture axis, with the smallest diameter section at the one end being of short length and small diameter. It is convenient, but not necessary, to coat the aperture wall with a parting layer which aids in the separation of the subsequently-formed miniature funnel-shaped electrode from the female mold and facilitates cleaning of the mold for reuse. Electrically conducting material such as copper, gold, or the like, to form the funnel-shaped electrode then is deposited on the parting layer to the desired thickness to provide the funnel-shaped electrode with the desired strength. For this step physical vapor deposition is preferred because of the flexibility of the process and the extreme accuracy of surface replication that can be achieved, however, any of the coating, plating or like processes can be used. The evaporant beam is directed onto the mold cavity from the large diameter end of the aperture from a source either on axis with the mold or at an angle to the mold axis, and the beam and mold are relatively rotated about such axis during metal deposition although rotation is not necessary with well aligned on axis deposition.

18 Claims, 5 Drawing Figures

FIG-1
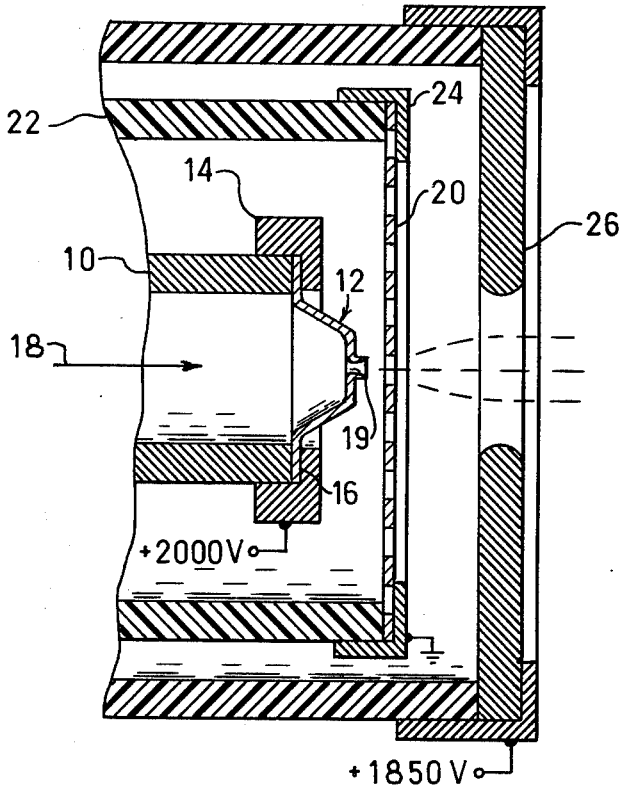
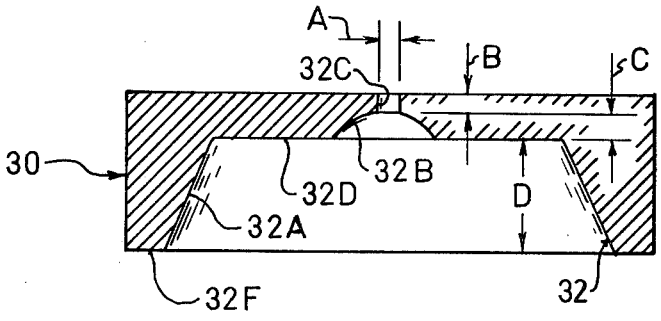
FIG-2A

METHOD OF FABRICATING A FUNNEL-SHAPED MINIATURE ELECTRODE FOR USE AS A FIELD IONIZATION SOURCE

BACKGROUND OF THE INVENTION

Field ionization of fluid samples by electronic tunneling due to potential barrier distortions in large electrostatic fields is well known, and numerous structures have been devised for producing the necessary field strength and for feeding fluid to be ionized into the ionizing region. The use of a small diameter tube, or capillary, as one electrode of a field ionization source, through which tube the fluid, such as gas, to be ionized is fed is known and useful when high gas pressures are available. A high electrostatic field necessary for ionization is provided by locating a second electrode adjacent the exit end of the tube, and applying a potential difference across said electrodes. However, as a practical matter, the gas conductance through a small diameter tube having a length that can be reasonably handled is extremely limited. Consequently substantially no use of capillary-type electrodes in field ionization sources has been made.

SUMMARY OF THE INVENTION

A principal object of this invention is the provision of a method of fabricating an easily handled practical capillary-type electrode in the form of a miniature funnel having thin walls and very sharp edges for use in a field ionization source which source, then, is capable of providing a small and substantially parallel beam of ions with superior ion-optic properties at high beam currents and high current densities with high ionization efficiency, and which source may be operated at relatively low voltages.

In carrying out the present invention, a matrix or female mold having at least one generally frustoconical-shaped aperture therethrough is prepared. The aperture wall may be formed with a series of generally tapered wall sections of progressively smaller diameter in going through the mold. A small diameter, short length, end section of the aperture serves to form a short tube orifice at the exit end of the subsequently-formed funnel-electrode. The aperture wall and large-diameter end of the female mold first are coated with a parting layer which substantially conforms to the shape of the mold. Conducting material is deposited on the parting layer, which material generally conforms to the shape of the coated mold and which forms the funnel electrode with a short thin walled tube orifice. When the metal has been deposited to the desired thickness, the electrode is removed from the mold by pulling it free if not strongly adhered to the parting layer, or by first dissolving the parting layer in a solvent and then pulling the electrode from the mold. Preferably, the parting layer and metal are deposited at an angle to the mold aperture while relatively rotating the mold and coating and metallic sources about the mold axis. In this way, the angle of incidence of the deposited material on the aperture wall is minimized with the result that the parting layer and metal are of a finer texture than they would be if deposited at a greater angle of incidence. Employing this fabrication method, a sharp edge is formed at the small-diameter exit end of the electrode since only a relatively small amount of metal is deposited within the small diameter, slightly tapered, end of the mold.

BRIEF DESCRIPTION OF DRAWINGS

In the drawings, wherein like reference characters refer to the same parts in the several views:

FIG. 1 is a fragmentary cross-sectional diagrammatic view of a field ionization source which incorporates a funnel-shaped electrode formed in accordance with the present invention, and FIGS. 2A through 2D are enlarged cross-sectional views showing various steps in the manufacture of the funnel-electrode included in the FIG. 1 arrangement.

Referring to FIG. 1, the field ionization source shown therein includes a conductive support tube 10 to which a funnel-electrode 12 fabricated in accordance with the present invention is removably secured by use of a collar 14. A radially extending flange 16, formed at the base of the electrode 12, is clamped to the tube 10 between the tube end and an inwardly directed flange formed on the collar. Fastening means, not shown, are included for removably securing the collar to the tube.

Figure 2B:
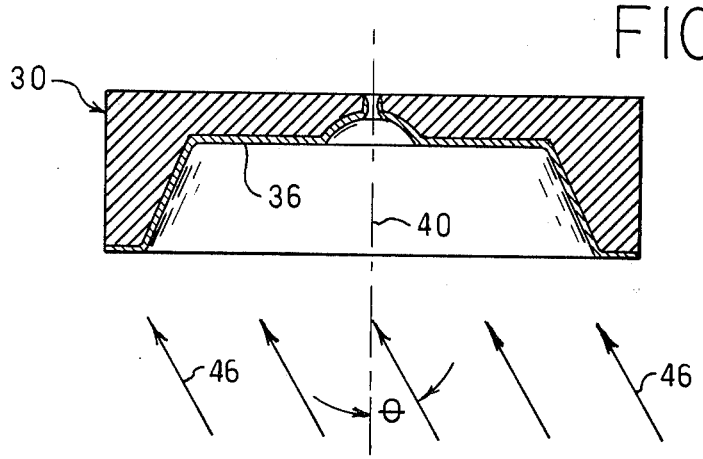

Sample gas, or liquid, is fed to the electrode 12 through the tube 10 in the direction of arrow 18. The tube 10 is electrically conductive so that electrical connection can be made to the electrode 12 through the tube. A small diameter, short, thin walled, sharp edged tube orifice 19 is formed at the exit end of the funnel-electrode 12 through which sample fluid from the tube 10 flows for ionization thereat.

A second electrode 20 is located adjacent the electrode 12 for the establishment of a large electrostatic field therebetween. In the illustrated arrangement the electrode 20 comprises a grid which is spaced, say 25 microns from the electrode 12, with a grid opening in register with the orifice 19. The grid simply may comprise, for example, a 250 mesh screen firmly secured in place on the outer end of an insulating tube 22 by use of an apertured cap 24 suitably attached to the tube as by use of set screws, not shown. A focusing electrode 26 may be included to collimate ions produced by the field ionizing source. For operation, the electrodes 12, 20 and 26 may be supplied with potentials of, say, +2000V, ground, and +1850V, respectively. Obviously, the present invention is not limited to the particular voltages employed, or to any particular use which is made of the ion source which includes the funnel-electrode 12. In use, the ion beam may be directed onto a target for ion etching, ion implantation, or the like, or supplied to a spectrometer for mass analysis.

Figure 2C:
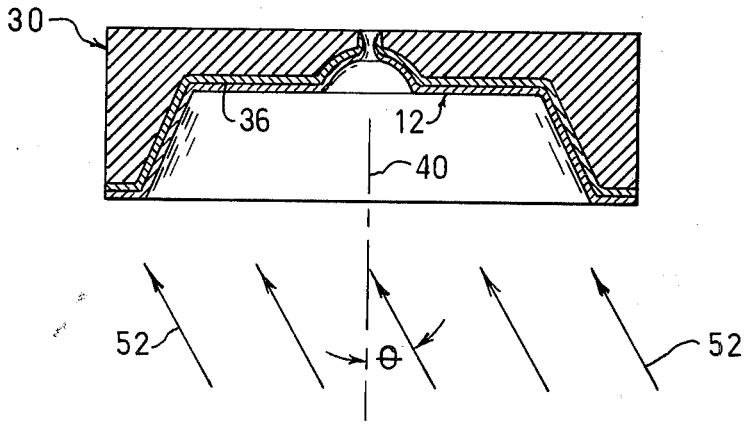

The novel method of fabricating the funnel-electrode 12 now will be described with reference to FIGS. 2A through 2D. A female mold, or matrix, 30 shown in FIGS. 2A, 2B and 2C, is employed in the fabrication of the spout, or funnel, electrode 12. The matrix is formed of any suitable material, such as metal. The illustrated mold is made from a flat plate or slab of metallic material, and is formed with an axially aligned aperture 32 which extends therethrough. The aperture varies in size from a large diameter at one end, for formation of the entrance end of the spout electrode, to an extremely small diameter at the opposite end, for formation of the electrode orifice. In the illustrated arrangement the aperture includes generally tapered large, intermediate and small diameter wall sections 32A, 32B and 32C, with the large and small opposite end sections 32A and 32C and the intermediate section 32B being of generally frustoconical or semispherical shape. A shoulder 32D is frequently formed between the large and intermediate wall sections 32A and 32B, and a flat annular end 32F is formed at the large diameter end of the matrix for the formation of the radial mounting flange 16 of the funnel-electrode. Because of the extreme variation in the aperture diameter, the matrix, and the funnel-electrode formed using the same, are not shown to scale in the drawings. In one arrangement, which has been built and tested, matrix dimensions identified by the reference characters A, B, C and D in FIG. 2A on the order of about 20, 20, 245 and 650 microns, respectively, were employed. Obviously, the matrix is not limited to such dimensions. However, it will be noted that both the length and diameter of the small diameter end section 32C are of extremely small dimension.

The fabrication of the matrix is not novel and can be done by any suitable process, or combination of processes including drilling, spark electric discharge, machining, chemical machining, forging, stamping, casting, electroforming, replication of a master, chemical and mechanical polishing, or the like micromachining processes. The working surface of the matrix should be smooth for use in forming the funnel-electrode.

After the matrix, or female mold, 30 has been prepared, the aperture 32 and end wall 32F are coated with a parting layer which aids in the separation of the funnel-electrode from the matrix and facilitates cleaning of the matrix for subsequent use. The coating layer, which is identified by the reference character 36 in FIGS. 2B and 2C, can be applied as by plating, chemical vapor deposition, spraying, spinning, physical vapor deposition, or any other technique that produces a smooth continuous coating. The parting layer is of some highly soluble material with solvents that do not attack the matrix or subsequently formed funnel-electrode. Aluminum, aluminum-oxide, nickel, calcium floride, and sodium chloride are examples of suitable parting layer materials. Sodium chloride is simple to work with because its solvents, which include water, are easy to handle, and its solubility is very high.

The mold or matrix, aperture is formed with a smooth surface and it will be apparent that the parting layer also must be smooth to facilitate parting and to preserve definition of detail in the finished part. As is well known, thin metal films deposited onto a surface at a grazing angle often take a rough textured surface. Consequently, from an inspection of FIG. 2B, it will be seen that if an evaporator is positioned to provide an evaporant beam directed in line with the aperture axis 40, the evaporant would arrive at the generally tapered wall sections 32A, 32B and 32C at a very steep angle and could thereby result in a rough textured surface. In particular, the parting layer within the wall section 32C which is only slightly tapered could have a rough texture. A preferred technique to minimize surface roughness is to deposit the material at an angle to the aperture axis while relatively rotating the evaporant beam and matrix about the mold axis, as shown in FIGS. 2B and 2C.

Referring first to FIG. 2B, wherein the step of coating the matrix with the parting layer 36 is shown, a physical vapor deposition technique which employs a vacuum chamber, not shown, is used in the coating process. The coating material, such as sodium chloride, is placed in an evaporator, not shown, and is heated by energy from any suitable source to evaporate the same. The evaporator is placed sufficiently far from the mold to produce a beam of molecules arriving at the mold that is reasonably parallel and directed toward the mold aperture at an angle $\theta$ to the aperture and mold axis 40. The mold is rotated about the mold axis 40 during the coating process. With the single orifice arrangement illustrated, the mold and aperture axes are coincident. With multi-orifice arrangements, it will be apparent that some, if not all aperture axes would parallel the mold axis at a spaced distance therefrom. In this way, the angle of incidence of the evaporant on the small-diameter wall section 32C is minimized with the result that the film 36 is of a finer texture than if it was deposited at a steeper angle of incidence.

After the parting layer 36 has been deposited, the funnelelectrode is formed by depositing the desired thickness of electrically conducting material onto the coated matrix. Again, as with the application of the parting layer, this material also may be applied by any suitable process such as plating chemical vapor deposition, spraying, spinning, physical vapor deposition, or the like. Physical vapor deposition is preferred because of the extreme accuracy of surface replication that can be achieved using this technique. Many different materials may be used, including copper, and for purposes of illustration the conductive material is placed in a boat and heated to provide a beam 52 which is directed onto the parting layer. As with the application of the parting layer, the beam 52 is directed at an angle $\theta$ to the mold axis 40, while the matrix is rotated about such axis. The deposition is continued until the desired thickness of material is obtained to provide the resultant funnel-electrode 12 with the necessary strength. Depending upon the material employed, a thickness on the order of between, say 10 to 50 $\mu$m tapering down to fractions of a micron at the small rim of the funnel orifice is typical.

When the electrode material has been deposited to the desired thickness, the electrode is removed from the matrix as by pulling it free if it is not strongly adhered to the parting layer. If necessary, or desired, the parting layer 36 first may be dissolved, after which the spout-electrode 12 is easily removed from the matrix.

Figure 2D:
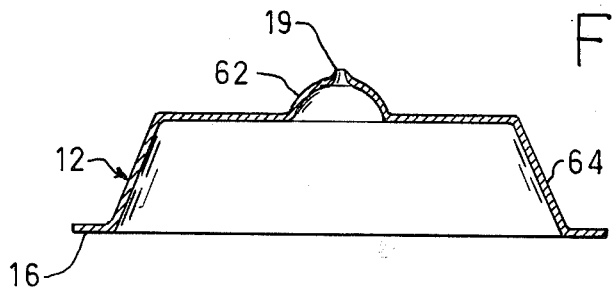

The resultant funnel-electrode, as shown in FIG. 2D, is formed with a short tube orifice 19 from which the fluid to be ionized flows. The inside diameter of such orifice depends upon a number of factors including the aperture diameter 32C formed in the matrix, and the thickness to which the parting layer and electrode materials are deposited. It will be apparent that with the present novel method of fabrication, an extremely small diameter orifice may be formed. Also of significance is the fact that the length of the orifice tube may be made very short for maximum conductance through the small diameter orifice. Yet the overall size of the electrode is sufficiently large to be relatively easily handled. For example, application to and removal from the inlet tube 10 of the ion source shown in FIG. 1 are performed with relative ease.

With the present fabrication method the short tube orifice 19 is easily located at the end of a relatively small diameter tapered tube section 62 whereby only the extreme tip of the orifice is located adjacent the counter electrode 20 thereby reducing the probability of electrical breakdown between the two electrodes. Also, the step-back provided by the large diameter wall section 64 provides ample space for the collar 14 for clamping the electrode to the tube 10. In general, field ionization sources employing the funnel-electrode fabricated in accordance with the present invention are capable of supplying high current and high current density ion beams with high ionization efficiency. A small, nearly parallel beam of ions may be produced with this source having superior ion optical properties. Ionization at relatively low voltages is possible using this source since the geometric dimensions are small and interelectrode spacings are small so a high flux density electrostatic field is established at the gas source thereby minimizing ion fragmentation by collision and ion optical problems associated with high energies.

The invention having been described in detail in accordance with the requirements of the Patent Statutes, various changes and modifications will suggest themselves to those skilled in this art. For example, the female mold could be formed of a suitable material which is dissolved with a solvent for separation of the funnel-electrode from the mold rather than pulling the same from the mold. Also, a multi-layer funnel-electrode is easily formed using different materials for the several layers. For example, to prevent chemical reactions at the electrode surface between the electrode and the fluid employed, the electrode could be coated with a material which is inert to the fluid. Also, as noted above, coating processes other than the illustrated physical vapor deposition process may be used in fabrication of the electrode.

Although a single orifice electrode is illustrated, it will be apparent that multi-orifice electrodes may be formed in accordance with the present teachings by use of a matrix, or female mold, formed with a plurality of stepped-wall apertures therein. Obviously, the invention is not limited to the illustrated aperture shape. The use herein of the term "generally tapered" or the like, is intended to include both truly tapered walls as well as those which curve, such as the wall 32B to provide the change from the large to the small diameter ends of the wall section. Obviously, where a soluble material mold is employed, no tapering of the mold walls is required for separation of the electrode from the mold. Also, it will be apparent that relative rotation of the evaporant beam and matrix may be employed. For example, the beam source may be rotated about the matrix axis while the matrix remains stationary. Additionally, micro-needles may be grown at the outer free end of the tube orifice of the electrode in any well known manner for improved operating efficiency of the ionization source. It is intended that the above and other such chanes and modifications shall fall within the spirit and scope of the invention as defined in the appended claims.

I claim:

1. A method of fabricating a funnel-electrode for use in a field ionization source, which method includes the use of a female mold formed with an aperture therethrough having a plurality of different diameter wall sections of decreasing size in going along the aperture axis, said method comprising the steps of;

a. depositing a layer of electrically conducting material onto the female mold to a thickness which tapers to less than about one micron at the small diameter end of the mold aperture and substantially conforms to the shape of the aperture therein to form a non-porous funnel-electrode, and b. separating said funnel-electrode from said female mold.

2. A method of fabricating a funnel-electrode as defined in claim 1 including, depositing a parting layer onto the female mold to substantially conform to the shape of the aperture therein before depositing said layer of electrically conducting material thereon.

3. A method of fabricating a funnel-electrode as defined in claim 2 wherein the step of separating said funnel-electrode from said female mold includes dissolving said parting layer.

4. A method of fabricating a funnel-electrode as defined in claim 1 wherein the step of separating said funnel-electrode from said female mold includes dissolving said mold.

5. A method of fabricating a funnel-electrode as defined in claim 1 wherein said layer of conducting material is deposited onto the female mold by directing a beam of electrically conducting material onto the mold from the large diameter section thereof.

6. A method of fabricating a funnel-electrode as defined in claim 5 wherein said beam of electrically conducting material is directed onto the mold at an intersecting angle with the aperture axis while relatively rotating said mold and beam.

7. A method of fabricating a funnel-electrode as defined in claim 6 wherein said beam of electrically conducting material is supplied from a stationary source while said mold is rotated about the mold axis.

8. A method of fabricating a funnel-electrode as defined in claim 1 wherein said different diameter wall sections of the female mold are generally tapered.

9. A method of fabricating a funnel-electrode for use in a field ionization source comprising;

a. preparing a female mold having an aperture substantially conforming in shape to at least a part of the funnel-electrode to be deposited thereon, which aperture extends through the mold and includes a plurality of increasingly smaller diameter generally tapered wall sections, b. depositing electrically conducting material on the female mold that substantially conforms to the mold to form a non-porous funnel-electrode with a wall thickness which tapers to less than about one micron at the small diameter end of the mold, and c. separating said funnel-electrode from said female mold.

10. A method of fabricating a funnel-electrode as defined in claim 9 wherein, said electrically conducting material is deposited onto the mold from the large diameter end of the aperture to cover the aperture wall and end wall of the mold to form the funnel-electrode and integral mounting flange.

11. A method of fabricating a funnel-electrode as defined in claim 9 wherein, the small diameter end of the aperture formed in the mold is of a short length for forming a short tube orifice on the funnel-electrode.

12. A method of fabricating a funnel-electrode as defined in claim 11 wherein the short tube orifice is formed having a length to diameter ratio of substantially 1:1.

13. A method of fabricating a funnel-electrode as defined in claim 1 wherein the electrically conducting material is deposited to a thickness of between about 10 to 50 microns.

14. A method of fabricating a funnel-electrode as defined in claim 1 wherein the small diameter end of the mold aperture is formed with a length of less than about 20 microns.

15. A method of fabricating a funnel-electrode as defined in claim 14 wherein the small diameter end of the mold aperture is formed with a diameter of less than about 20 microns.

16. A method of fabricating a funnel-electrode as defined in claim 9 wherein the electrically conducting material is deposited to a wall thickness of between about 10 to 50 microns.

17. A method of fabricating a funnel-electrode as defined in claim 9 wherein the small diameter end of the mold aperture is formed with a length of less than about 20 microns.

18. A method of fabricating a funnel-electrode as defined in claim 17 wherein the small diameter end of the mold aperture is formed with a diameter of less than about 20 microns.

* * * * *